US008528363B2

(12) United States Patent
Ha et al.

(10) Patent No.: US 8,528,363 B2
(45) Date of Patent: Sep. 10, 2013

(54) PROCESS AND APPARATUS FOR THE SEPARATION OF AIR BY CRYOGENIC DISTILLATION

(75) Inventors: Bao Ha, San Ramon, CA (US); Jean-Renaud Brugerolle, Neuchatel (CH)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 936 days.

(21) Appl. No.: 12/640,221

(22) Filed: Dec. 17, 2009

(65) Prior Publication Data

US 2011/0146344 A1 Jun. 23, 2011

(51) Int. Cl.
*F25J 3/00* (2006.01)

(52) U.S. Cl.
USPC ..... 62/646; 62/640; 62/643; 62/645

(58) Field of Classification Search
USPC ..... 62/643, 644, 645, 646, 647, 648, 62/649, 650, 651, 652
See application file for complete search history.

(56) References Cited

U.S. PATENT DOCUMENTS

| | | | | |
|---|---|---|---|---|
| 4,582,518 | A * | 4/1986 | Erickson | 62/650 |
| 5,069,699 | A * | 12/1991 | Agrawal | 62/646 |
| 5,337,570 | A * | 8/1994 | Prosser | 62/646 |
| 5,419,137 | A * | 5/1995 | Sweeney et al. | 62/646 |
| 5,546,766 | A * | 8/1996 | Higginbotham | 62/645 |
| 5,582,032 | A * | 12/1996 | Shelton et al. | 62/643 |
| 6,062,042 | A * | 5/2000 | McNeil et al. | 62/625 |
| 6,295,835 | B1 * | 10/2001 | Le Bot | 62/641 |
| 6,327,873 | B1 * | 12/2001 | Dray et al. | 62/648 |
| 6,666,048 | B1 * | 12/2003 | Brugerolle et al. | 62/644 |
| 2007/0130992 | A1 * | 6/2007 | Brugerolle et al. | 62/615 |

* cited by examiner

*Primary Examiner* — Frantz Jules
*Assistant Examiner* — Keith Raymond

(57) ABSTRACT

In a process for the production of nitrogen and of oxygen enriched liquid by separation of air by cryogenic distillation, a first stream of air is sent to an exchanger to form a first cooled air stream, the first cooled air stream is sent to a bottom reboiler of a column, condensed air is sent from the bottom reboiler to a top condenser of the column, vaporized air is sent from the top condenser to a first compressor, air is sent from the first compressor to the column, air is sent to a second compressor and from the second compressor to the exchanger to produce a cooled second air stream, the cooled second air stream is sent to a first turboexpander and from the turbo expander to the column, bottom liquid is removed from the column and gaseous nitrogen is removed from the top of the column.

11 Claims, 4 Drawing Sheets

PROCESS AND APPARATUS FOR THE SEPARATION OF AIR BY CRYOGENIC DISTILLATION

The present invention relates to a process and application for the separation of air by cryogenic distillation.

BACKGROUND OF THE INVENTION

Very large gas or coal gasification sites may be built in the near future. All gasification processes require large quantities of high pressure oxygen.

ASU plant sizes have been growing steadily over the last four decades and there is no sign for the trend to stop. With plant sizes getting larger and larger, liquid back-up issues become impractical or impossible for plant outages lasting for more than a few hours.

Current technologies would allow plant sizes up to 7000 metric tonnes of oxygen per day. Presently, largest reference plant sizes are between 4000 and 5000 metric tonnes per day.

Coal gasification in the near future for example may require very large oxygen consumption reaching as high as 50 000 T/D. Gas-to-liquid plants are another example with high oxygen requirement in the range of 20 000-40 000 T/D. It becomes obvious there is a need for an improved and rational production concept for oxygen in such large facilities.

This invention provides a new approach for building large facilities requiring multiple large trains of oxygen plants. A new concept for cost effective production back-up is also integrated in this new scheme.

DETAILED DESCRIPTION OF THE INVENTION

Figure 1:
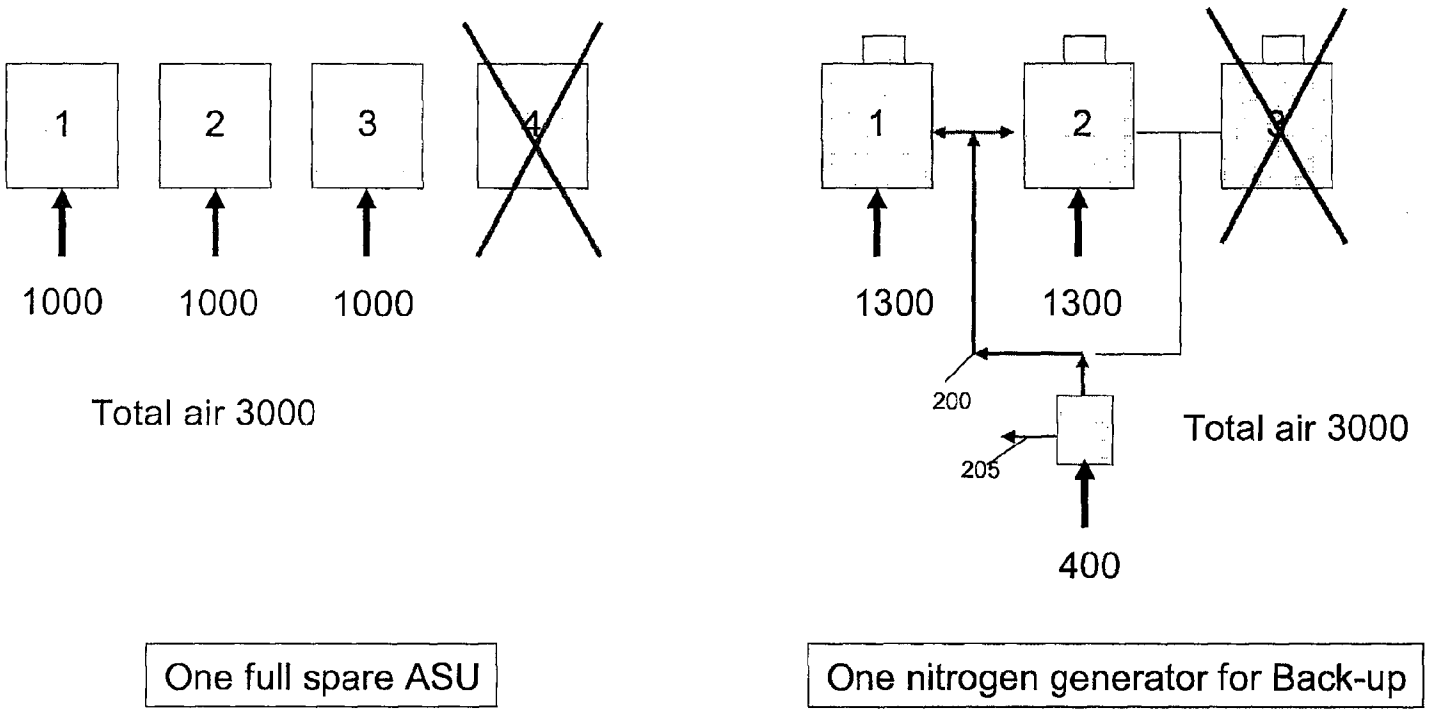
FIG. 1 illustrates one new approach of the invention for increasing production for backup purposes at lower cost as represented in one embodiment of the present invention.

This invention covers 3 main aspects for the cryogenic process for large air separation facilities:

1. The choice of the process of the oxygen plant: the objective of this invention is to provide an air separation process capable of very high oxygen production. Another feature of the selected process is its ability to efficiently accommodate higher air flow to increase the oxygen production.
2. The economical backup for multiple trains: the purpose of this aspect of the invention is to provide a new approach for backing up plant production by using an auxiliary unit such as nitrogen generator.

In order to reach a very high production throughput a different process scheme for air separation plant is needed. The traditional double column process operates at low feed air pressure about 6 bar requiring large adsorption vessels for front end clean up to remove moisture and $CO_2$ prior to the cryogenic portion of the oxygen plant.

The traditional approach for backing up the production facilities consisting of several trains operating in a parallel fashion is to install a full size spare train. This spare train or unit can be put in service in a short time to take over the slack of production caused by the outage of one of the components of the other trains. Since the probability of having two outages occurring at the same time is low, it is of common practice to have only one spare train to assure the reliability of the multiple trains. In some situations, if the start up time of the spare unit must be very short or instantaneous then all equipment including the spare unit must run permanently at a reduced rate; when one unit is shut down then the production rate of the remaining units can be increased very rapidly to maintain the overall production.

According to the present invention, there is provided an apparatus for the production of nitrogen and of oxygen enriched liquid by cryogenic distillation of air comprising a column having a top condenser and a bottom reboiler, a first compressor, a second compressor, a first turboexpander, a heat exchanger, conduit means for sending a first stream of air to the exchanger to form a first cooled air stream, conduit means for sending the first cooled air stream to the bottom reboiler, conduit means for sending condensed air from the bottom reboiler to the top condenser, conduit means for sending vaporized air from the top condenser to the first compressor, conduit means for sending air from the first compressor to the column, conduit means for sending air to a second compressor and from the second compressor to the exchanger to produce a cooled second air stream, conduit means for sending the cooled second air stream to the first turboexpander and from the turboexpander to the column, conduit means for removing bottom liquid from the column and conduit means for removing gaseous nitrogen from the top of the column.

Optionally, the apparatus comprises:

- conduit means for sending liquid nitrogen to the top of the column.
- a further condenser, conduit means for sending bottom liquid from the column to the further condenser, conduit means for sending gaseous nitrogen from the top of the column to the further condenser and conduit means for removing vaporized bottom liquid from the further condenser.

According to the invention, there may be provided an installation for the production of oxygen including at least one air separation unit, at least one apparatus as described above, a compression means for sending air to at least one apparatus, compression means for sending air to at least one air separation unit, conduit means for removing oxygen from at least one air separation unit, conduit means for sending oxygen enriched liquid from the apparatus to a column of at least one air separation unit.

The installation may comprise:

- conduit means for sending to the conduit means for sending nitrogen rich liquid from a column of at least one air separation unit to the apparatus
- the compression means for sending air to at least one apparatus and compression means for sending air to at least one air separation unit comprises at least one compressor connected to at least one air separation unit and at least one apparatus.

According to a further aspect of the invention, there is provided a process for the production of nitrogen and of oxygen enriched liquid by separation of air by cryogenic distillation in which a first stream of air is sent to an exchanger to form a first cooled air stream, the first cooled air stream is sent to a bottom reboiler of a column, condensed air is sent from the bottom reboiler to a top condenser of the column, vaporized air is sent from the top condenser to a first compressor, air is sent from the first compressor to the column, air is sent to a second compressor and from the second compressor to the exchanger to produce a cooled second air stream, the cooled second air stream is sent to a first turboexpander and from the turbo expander to the column, bottom liquid is removed from the column and gaseous nitrogen is removed from the top of the column.

The process may comprise sending liquid nitrogen to the top of the column.

An integrated process for the production of oxygen in an installation comprises operating at least one air separation unit and at least one apparatus according to the process described above in which air is sent to the apparatus and to the air separation unit, bottom liquid from the apparatus is sent to a column of the air separation unit and oxygen is withdrawn from the air separation unit.

The process may involve at least first and second air separation units and bottom liquid is sent to the first air separation unit when the second air separation unit is not functioning.

Air from a compressor may be sent to the second air separation unit when the second air separation unit functions and to the apparatus when the second air separation unit is not functioning.

A new approach of the invention for increasing production for backup purposes at lower cost is illustrated in FIG. 1. As compared with the traditional approach wherein a full spare train is provided to assure the production, a simpler and lower cost nitrogen generator is proposed to replace the spare cold box. The nitrogen generator is designed to operate at similar pressure as the oxygen plants, about 11 bar in our invention, to assure simple compressor equipment backup. However other pressures could be used.

This backup concept using a nitrogen generator can be applied in general to a multiple trains arrangement of cryogenic oxygen plants. In the following detailed description the nitrogen generator is deployed in conjunction with the cold box process similar to the one described in FIG. 4 of our invention. In FIG. 1, the nitrogen generator separates air into a nitrogen rich stream 205 and a very rich liquid stream 200. It is useful to note the composition of the very rich liquid stream 200 is similar to the composition of the very rich liquid 12 of FIG. 4.

Figure 2:
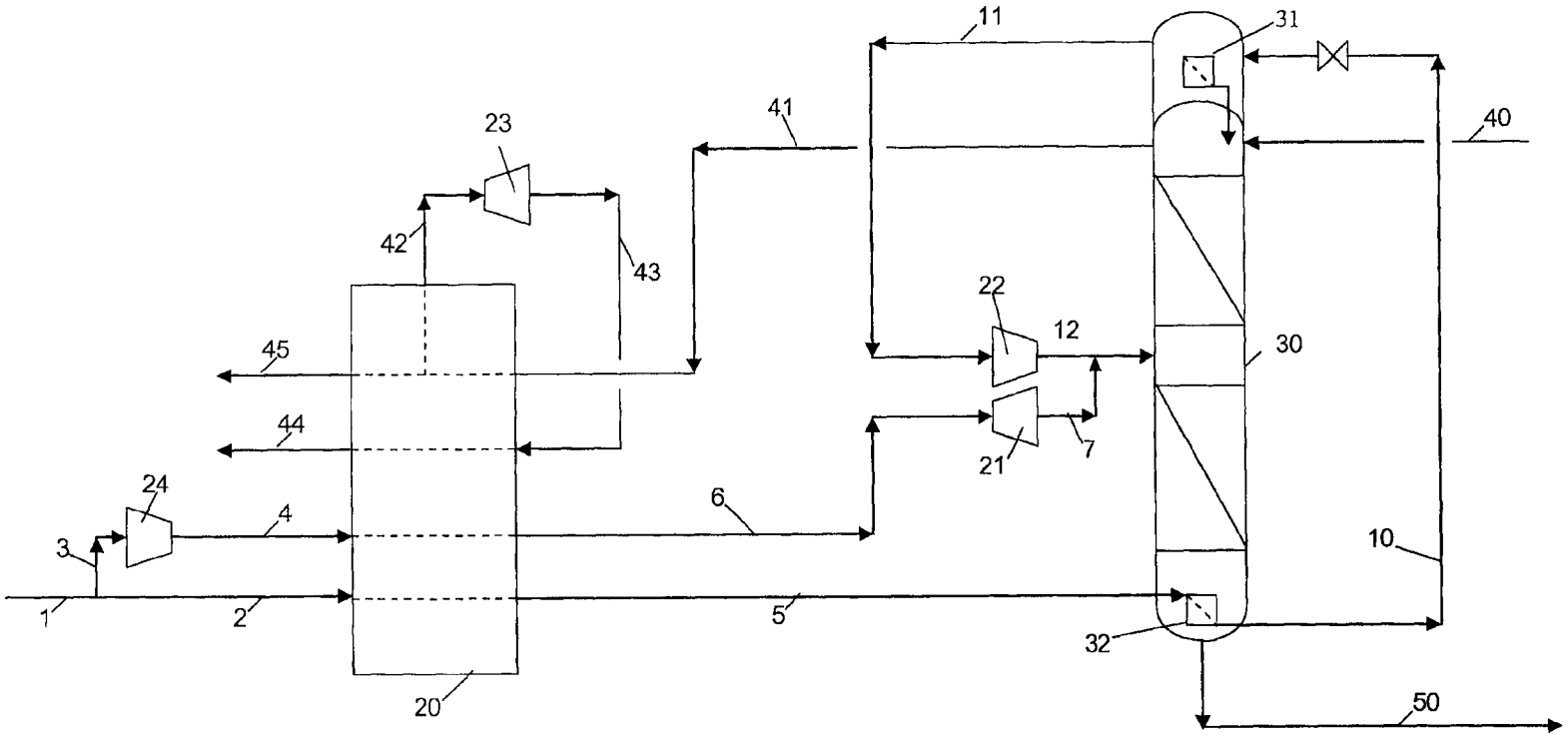
FIG. 2 illustrates the details of the nitrogen generator in accordance with one embodiment of the present invention.

The embodiment of FIG. 2 shows the details of the nitrogen generator: a portion 3 of compressed, cooled and purified feed air 1 at 11 bars is further compressed by compressor 24 to form stream 4 at higher pressure. Stream 4 is then cooled in exchanger 20 and expanded into the distillation column 30 via expander 21. Another portion 2 of feed air is cooled in exchanger 20 and condenses in exchanger 32 to provide boilup to the column. The condensed air 10 thus formed is then expanded and sent to condenser 31 to be vaporized at lower pressure against condensing gas at the top of the column 30. The vaporized air 11 exiting condenser 31 is then cold compressed in cold compressor 22 to form stream 12 and enters the column for distillation. Column 30 separates feed air into nitrogen rich gas at the top and a very rich liquid 50 at the bottom. Nitrogen rich gas condenses in condenser 31 to yield liquid reflux for distillation. A portion of nitrogen rich gas 41 is recovered and warmed as nitrogen product 45 in exchanger 20. A portion 42 of the nitrogen rich gas can be optionally expanded in expander 23 to provide additional refrigeration.

When used as backup unit for the multiple oxygen trains, the nitrogen generator receives air 1 from the compressor previously supplying air to the now shutdown train, this air 1 is separated into a very rich liquid 50 at about 65 mol % of oxygen and a nitrogen stream 41. The very rich liquid stream 60 is sent to the oxygen plant of FIG. 4 via stream 88. In order to maintain the balance of refrigeration of both oxygen plant and nitrogen generator, a liquid nitrogen stream is extracted from the oxygen plant via stream 89 of FIG. 4 and sent to the nitrogen generator (stream 40 of FIG. 2). Since the very rich liquid feed 60 to the oxygen plant contains much less nitrogen than air (about 35 mol % instead of 78%), the increase of oxygen production supplied by the very rich liquid does not increase the nitrogen flow at the top of the columns as much as in the case of air. Therefore the system can generate higher oxygen flow in the form of gaseous oxygen stream 72. The illustration of FIG. 1 shows the effectiveness of such system with three oxygen trains: instead of having a full spare train treating 1000 units of air, a much smaller nitrogen generator treating only 400 units of air which is 60% smaller can be used as a spare production unit. The concept of air boosting with higher air flow via the second low pressure column as described above can be used with this nitrogen generator. The net result is by boosting the air flow to about 1300 or 30% above design and feeding the oxygen plant with very rich liquid supplied by the nitrogen generator, each production train can output about 50% increase in oxygen production. With only 2 oxygen trains and a nitrogen generator, the total oxygen output is the same as with 3 oxygen plants. The nitrogen generator backup system is much smaller and lower in cost.

Figure 3:
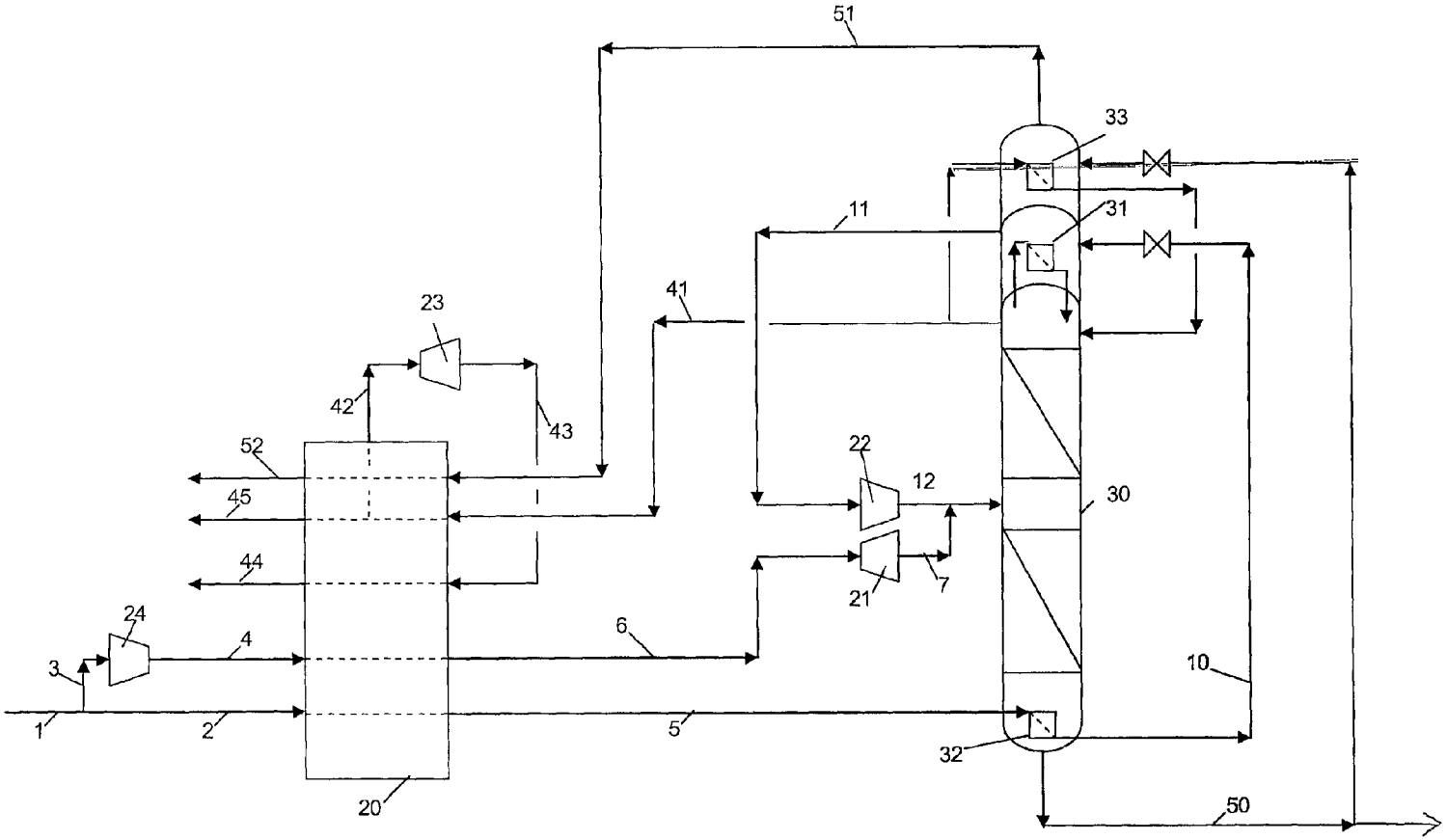
FIG. 3 shows one embodiment of the nitrogen generator operated under stand alone mode to supply nitrogen utility gas to the complex in accordance with one embodiment of the present invention.

During startup and schedule shutdown time, there is a need for nitrogen utility at such large production facilities (nitrogen blanket, instrument gas etc.). The nitrogen generator can be used conveniently to supply the needed nitrogen utility during such period. FIG. 3 shows an embodiment of the nitrogen generator operated under stand alone mode to supply nitrogen utility gas to the complex. In this mode, all or part of the very rich liquid is vaporized at low pressure in another condenser 33 located at the top of the column. The vaporized stream 51 is then warmed in exchanger 20 and exits as stream 52.

Figure 4:
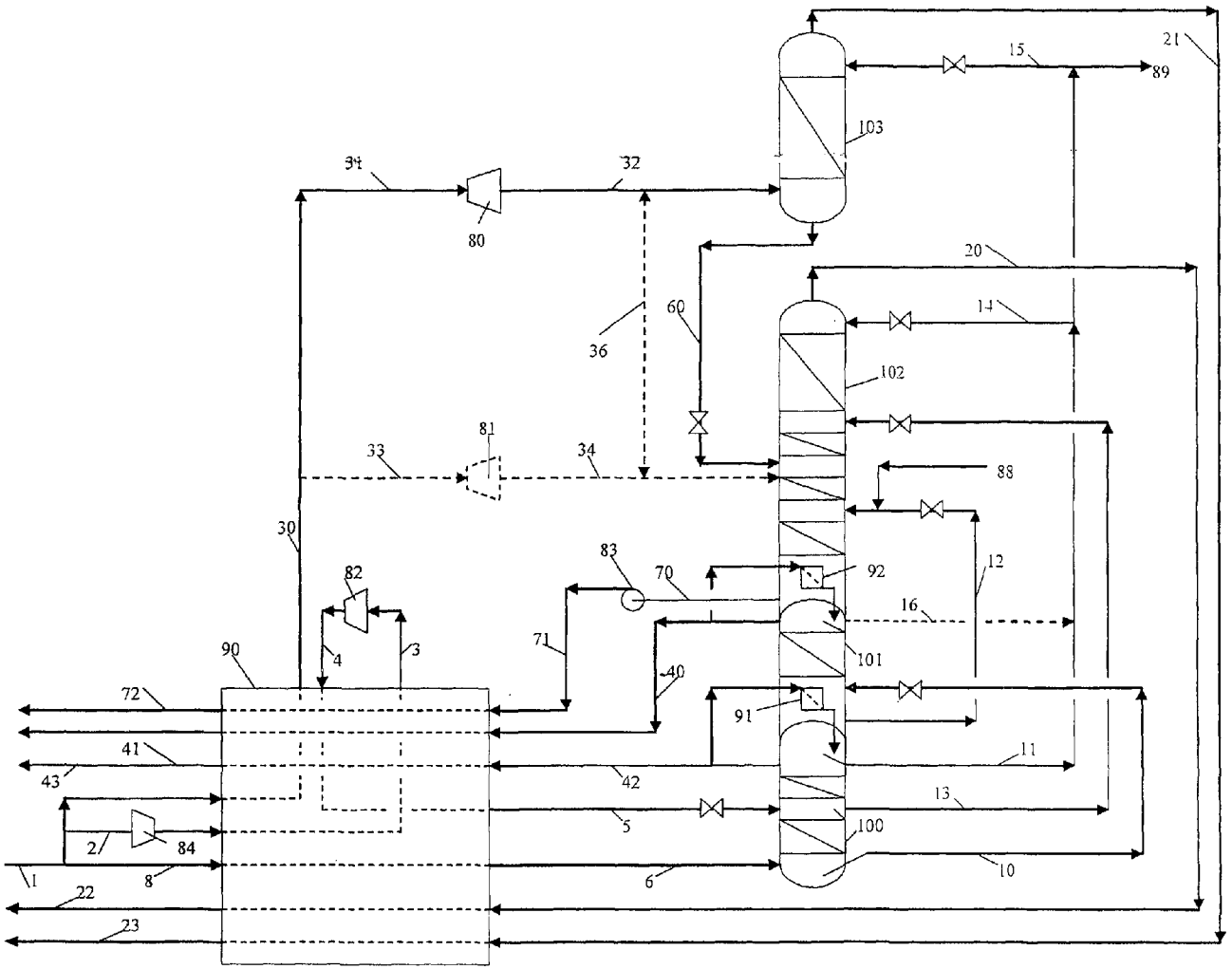
FIG. 4 illustrates a system with a high pressure column, an intermediate pressure column, a low pressure column, and an auxiliary column in accordance with one embodiment of the present invention.

The apparatus of FIG. 4 comprises a high pressure column 100, an intermediate pressure column 101 and a low pressure column 102. An auxiliary column 103 is also used.

The air feed to this process is at about 11 bar which results in more compact and less bulky adsorber vessels. The adsorbers can be used for higher air flow since the air is more dense and high pressure is more favorable for the adsorption of moisture and $CO_2$.

The top vapor flow of the high pressure column is reduced by expanding high pressure feed air into the auxiliary low pressure column which distils the air in to a top nitrogen stream and a bottom liquid rich in oxygen. The auxiliary low pressure column operates at a similar pressure to the low pressure column, it is fed by liquid nitrogen reflux at the top. This pressure may be lower than, higher than or equal to the pressure of the low pressure column. A liquid air stream can be optionally fed to this auxiliary column to improve its distillation performance.

Air 1 at 11 bar is divided into three streams following compression, cooling and purification.

One of the streams is stream 8 which cools in the heat exchanger 90 to form stream 6 which is sent in gaseous form to the high pressure column 100. It is separated in the high pressure column 100 into a nitrogen rich stream at the top and a rich liquid stream 10 rich in oxygen at the bottom. The nitrogen rich stream condenses in a first condenser 91 to yield a first liquid reflux stream. Some nitrogen 42 can be extracted at the top of the high pressure column as a product stream and sent to the heat exchanger 90 to be warmed. A portion 11 of the first reflux stream is sent to the low pressure column 102 as reflux stream 14 and to the auxiliary column 103 as reflux 15. Portion 89 of the reflux stream may serve as a nitrogen liquid product. All or a portion of the bottom rich liquid 10 is sent to the bottom of the intermediate column 101 for further distillation. The intermediate column operates at an intermediate pressure between the high pressure column's pressure and the low pressure column's pressure. The first condenser 91 transfers heat between the top of the high pressure column and the bottom of the intermediate column. The intermediate column separates the rich liquid into a second nitrogen rich gas at the top and a very rich liquid 12 at the bottom. Part of the second nitrogen rich gas condenses in a second condenser 92 to yield a second reflux stream and the rest 40 is removed as a gaseous stream and warmed in heat exchanger 90. The very rich liquid 12 is sent to the low pressure column 102 as feed. A portion of the second reflux stream 16 formed in the condenser 92 may be sent to the low pressure column as reflux. The second condenser 92 transfers heat between the top of the intermediate column 101 and the bottom of the low pressure column 102.

Instead of only expanding the feed air to the low pressure column, a portion 31 of feed air is expanded into an auxiliary column 103 using a turbine 80. The auxiliary column works at a pressure between 1.1 bar absolute and 1.8 bar absolute, which is about the same as the pressure of the low pressure column 102. A portion of liquid reflux 15 produced in either high pressure column or intermediate column is fed to the top of the auxiliary column as reflux. This auxiliary column 103 separates the expanded air 32 into nitrogen rich gas 21 at the top and a second rich liquid 60 rich in oxygen at the bottom. The second rich liquid is then expanded and transferred to the low pressure column 102 as feed. The auxiliary column 103 can be located above the low pressure column 102 such that the second rich liquid 60 can flow into the low pressure column by gravity feed, or a transfer pump can be used. The low pressure column 102 separates its feeds into the oxygen liquid 70 at the bottom and low pressure nitrogen gas 20 at the top. The oxygen liquid is pumped to high pressure and vaporized in the main exchanger 90 to yield the gaseous high pressure oxygen product 72. A portion 2 of feed air is further compressed in a warm booster 84, cooled in the heat exchanger 90, to form stream 3, compressed in a cold compressor 82 to form high pressure stream 4 and is used to condense against vaporizing liquid oxygen product in the main exchanger 90. The fluid 5 coming from the exchanger 90 is liquefied and sent to the high pressure column 100.

Part of the feed air 30 at 11 bars may or may not be expanded as stream 33 in turbine 81 to form stream 34 which is sent to the low pressure column 102.

By feeding a very rich liquid produced in the intermediate column to the low pressure column the distillation performance of the low pressure column is greatly improved such that significant expanded air flow to the second low pressure column, combined with significant nitrogen extracted in the high pressure column and/or the intermediate column, can be performed with good oxygen recovery rate.

In the embodiment described in FIG. 1 the cold compression scheme for O2 vaporization is illustrated: the pressure of the air fraction 2 is boosted by compressor 84 and then cooled in exchanger 90 to yield a cold pressurized air stream 3, which is then cold compressed by compressor 82 to yield stream 4 at even higher pressure. Stream 4 is next cooled in exchanger 90 to yield a liquid stream 5 which is then fed to the column system. A portion 33 of feed air can be optionally expanded into the low pressure column 102 to provide additional refrigeration to the system. A portion of low pressure expanded air at the outlet of the expanders 80 or 81 can be sent to the columns 103 and 102 by way of line 36 to evenly distribute the air flow to the columns as needed.

The vapor flow rate in the auxiliary column 103 is determined such that the diameters of the upper sections of the low pressure column 102 are not larger than that for any other section of the multiple distillation column system. Here the low pressure column 102 has the same diameter throughout as the high pressure column 100.

The enhancement of the distillation performance provided by the triple column arrangement of columns 100, 101 and 102 allows us to achieve a vapor flow rate at the top of the auxiliary separation column 103 greater than about 50 percent of the vapor flow rate at the top of the upper low pressure column sections under normal operation.

The invention claimed is:

1. Apparatus for the production of nitrogen and of oxygen enriched liquid by cryogenic distillation of air comprising a column having a top condenser and a bottom reboiler, a first compressor, a second compressor, a first turboexpander, a heat exchanger, a conduit configured to send a first stream of air to the exchanger to form a first cooled air stream, a conduit configured to send the first cooled air stream to the bottom reboiler, a conduit configured to send condensed air from the bottom reboiler to the top condenser, a conduit configured to send vaporized air from the top condenser to the first compressor, a conduit configured to send air from the first compressor to the column, a conduit configured to send air to a second compressor and from the second compressor to the exchanger to produce a cooled second air stream, a conduit configured to send the cooled second air stream to the first turboexpander and from the turboexpander to the column, a conduit configured to remove bottom liquid from the column and a conduit configured to remove gaseous nitrogen from the top of the column.

2. Apparatus according to claim 1 comprising a conduit configured to send liquid nitrogen to the top of the column.

3. Apparatus according to claim 1 comprising a further condenser, a conduit configured to send bottom liquid from the column to the further condenser, a conduit configured to send gaseous nitrogen from the top of the column to the further condenser and a conduit configured to remove vaporized bottom liquid from the further condenser.

4. Installation for the production of oxygen including at least one air separation unit, at least one apparatus according to one of the preceding claims, a compression means for sending air to at least one apparatus, compression means for sending air to at least one air separation unit, a conduit configured to remove oxygen from at least one air separation unit, a conduit configured to send oxygen enriched liquid from the apparatus to a column of at least one air separation unit.

5. Installation according to claim 4 including a conduit configured to send nitrogen rich liquid from a column of the at least one air separation unit to the apparatus.

6. Installation according to claim 4 wherein the compression means for sending air to at least one apparatus and the compression means for sending air to at least one air separation unit comprises at least one compressor connected to the at least one air separation unit and the at least one apparatus.

7. Process for the production of nitrogen and of oxygen enriched liquid by separation of air by cryogenic distillation in which a first stream of air is sent to an exchanger to form a first cooled air stream, the first cooled air stream is sent to a bottom reboiler of a column, condensed air is sent from the bottom reboiler to a top condenser of the column, vaporized air is sent from the top condenser to a first compressor, air is sent from the first compressor to the column, air is sent to a second compressor and from the second compressor to the exchanger to produce a cooled second air stream, the cooled second air stream is sent to a first turboexpander and from the turbo expander to the column, bottom liquid is removed from the column and gaseous nitrogen is removed from the top of the column.

8. Process according to claim 7 comprising sending liquid nitrogen to the top of the column.

9. Integrated process for the production of oxygen in an installation comprising at least one air separation unit and at least one apparatus operating according to the process for claim 7 in which air is sent to the apparatus and to the air separation unit, bottom liquid from the apparatus is sent to a column of the air separation unit and oxygen is withdrawn from the air separation unit.

10. Process according to claim 9 wherein the process involves at least first and second air separation units and bottom liquid is sent to the first air separation unit when the second air separation unit is not functioning.

11. Process according to claim 10 wherein air from a compressor is sent to the second air separation unit when the second air separation unit functions and to the apparatus when the second air separation unit is not functioning.

* * * * *